US006398905B1

(12) United States Patent
Ward

(10) Patent No.: US 6,398,905 B1
(45) **Date of Patent: *Jun. 4, 2002**

(54) APPARATUS AND METHOD FOR REDUCING REMOVAL FORCES FOR CMP PADS

(75) Inventor: Trent T. Ward, Kuna, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/478,692

(22) Filed: Jan. 6, 2000

Related U.S. Application Data

(63) Continuation of application No. 09/124,329, filed on Jul. 29, 1998, now Pat. No. 6,036,586.

(51) Int. Cl.[7] ..... C23F 1/02
(52) U.S. Cl. ..... 156/345; 451/288
(58) Field of Search ..... 156/345; 451/283–289

(56) References Cited

U.S. PATENT DOCUMENTS

| | | | | |
|---|---|---|---|---|
| 5,232,875 A | | 8/1993 | Tuttle et al. | 438/693 |
| 5,302,233 A | | 4/1994 | Kim et al. | 438/692 |
| 5,314,843 A | | 5/1994 | Yu et al. | 438/692 |
| 5,434,107 A | | 7/1995 | Paranjpe | 428/80 |
| 5,533,924 A | | 7/1996 | Stroupe et al. | 451/286 |
| 5,554,065 A | | 9/1996 | Clover | 451/283 |
| 5,569,062 A | | 10/1996 | Karlsrud | 451/285 |
| 5,575,707 A | | 11/1996 | Talieh et al. | 451/173 |
| 5,618,381 A | | 4/1997 | Doan et al. | 438/633 |
| 5,624,299 A | | 4/1997 | Shendon | 451/28 |
| 5,624,300 A | | 4/1997 | Kishii et al. | 451/36 |
| 5,624,303 A | | 4/1997 | Robinson | 451/285 |
| 5,624,304 A | | 4/1997 | Pasch et al. | 451/287 |
| 5,639,697 A | | 6/1997 | Weling et al. | 438/633 |
| 5,643,046 A | | 7/1997 | Katakabe et al. | 451/6 |
| 5,643,050 A | | 7/1997 | Chen | 451/10 |
| 5,643,406 A | | 7/1997 | Shimomura et al. | 438/693 |
| 5,643,837 A | | 7/1997 | Hayashi | 438/693 |
| 5,743,788 A | * | 4/1998 | Vanell | 451/41 |

FOREIGN PATENT DOCUMENTS

| | | |
|---|---|---|
| EP | 0683511 A2 | 11/1995 |

* cited by examiner

*Primary Examiner*—Robert Kunemund
*Assistant Examiner*—Kin-Chan Chen
(74) *Attorney, Agent, or Firm*—TraskBritt

(57) ABSTRACT

An improvement in a polishing apparatus for planarizing substrates comprises a tenacious coating of a low-adhesion material to the platen surface. An expendable polishing pad is adhesively attached to the low-adhesion material, and may be removed for periodic replacement at much reduced expenditure of force. Polishing pads joined to low-adhesion materials such as polytetrafluoroethylene (PTFE) by conventional adhesives resist distortion during polishing but are readily removed for replacement.

13 Claims, 5 Drawing Sheets

APPARATUS AND METHOD FOR REDUCING REMOVAL FORCES FOR CMP PADS

CROSS REFERENCE TO RELATED APPLICATION

This application is a continuation of application Ser. No. 09/124,329, filed Jul. 29, 1998, now U.S. Pat. No. 6,036,586.

BACKGROUND OF THE INVENTION

1. Field of the Invention

This invention relates generally to polishing methods and apparatus. More particularly, the invention pertains to apparatus and methods for polishing and planarizing semiconductor wafers, optical lenses and the like.

2. State of the Art

In the manufacture of semiconductor devices, it is important that the surface of a semiconductor wafer be planar.

For high density semiconductor devices having features with extremely small sizes, i.e. less than 1 $\mu$m, planarity of the semiconductor wafer is particularly critical to the photolithographic forming of the extremely small conductive traces and the like.

Methods currently used for planarization include (a) reflow planarization, (b) application of a sacrificial dielectric followed by etch back planarization, (c) mechanical polishing, and (d) chemical mechanical polishing (CMP). Methods (a) through (c) have some applications but have disadvantages for global wafer planarization, particularly when fabricating dense, high speed devices.

In U.S. Pat. No. 5,434,107 of Paranjpe, a planarization method consists of applying an interlevel film of dielectric material to a wafer—and subjecting the wafer to heat and pressure so that the film flows and fills depressions in the wafer, producing a planar wafer surface. An ultra flat member overlying the dielectric material ensures that the latter forms a flat surface as it hardens. The ultra flat member has a non-stick surface such as polytetrafluoroethylene so that the interlevel film does not adhere thereto.

In a similar method shown in European Patent Publication No. 0 683 511 A2 of Prybyla et al. (AT&T Corp.), a wafer is covered with a hardenable low-viscosity polymer and an object with a highly planar surface is placed in contact with the polymer until the polymer is cured. The object is separated from the polymer, which has cured into a highly planar surface.

The planarization method of choice for fabrication of dense integrated circuits is typically chemical mechanical polishing (CMP). This process comprises the abrasive polishing of the semiconductor wafer surface in the presence of a liquid or slurry.

In one form of CMP, a slurry of an abrasive material, usually combined with a chemical etchant at an acidic or alkaline pH, polishes the wafer surface in moving compressed planar contact with a relatively soft polishing pad or fabric. The combination of chemical and mechanical removal of material during polishing results in superior planarization of the polished surface. In this process it is important to remove sufficient material to provide a smooth surface, without removing an excessive quantity of underlying materials such as metal leads. It is also important to avoid the uneven removal of materials having different resistances to chemical etching and abrasion.

In an alternative CMP method, the polishing pad itself includes an abrasive material, and the added "slurry" may contain little or no abrasive material, but is chemically composed to provide the desired etching of the surface. This method is disclosed in U.S. Pat. No. 5,624,303 of Robinson, for example.

Various methods for improving wafer planarity are directed toward the application of interlayer materials of various hardness on the wafer surface prior to polishing. Such methods are illustrated in U.S. Pat. No. 5,618,381 of Doan et al., U.S. Pat. No. 5,639,697 of Weling et al., U.S. Pat. No. 5,302,233 of Kim et al., U.S. Pat. No. 5,643,837 of Hayashi, and U.S. Pat. No. 5,314,843 of Yu et al.

The typical apparatus for CMP polishing of a wafer comprises a frame or base on which a rotatable polishing pad holder or platen is mounted. The platen, for example, may be about 20–48 inches (about 50–122 cm.) or more in diameter. A polishing pad is typically joined to the platen surface with a pressure sensitive adhesive (PSA).

One or more rotatable substrate carriers are configured to compress e.g. semiconductor wafers against the polishing pad. The substrate carrier may include non-stick portions to ensure that the substrate, e.g. wafer, is released after the polishing step. Such is shown in U.S. Pat. No. 5,434,107 of Paranjpe and U.S. Pat. No. 5,533,924 of Stroupe et al.

The relative motion, whether circular, orbital or vibratory, of the polishing pad and substrate in an abrasive/etching slurry may provide a high degree of planarity without scratching or gouging of the substrate surface, depending upon wafer surface conditions. Variations in CMP apparatus are shown in U.S. Pat. No. 5,232,875 of Tuttle, U.S. Pat. No. 5,575,707 of Talieh, U.S. Pat. No. 5,624,299 of Shendon, U.S. Pat. No. 5,624,300 of Kishii et al., U.S. Pat. No. 5,643,046 of Katakabe et al., U.S. Pat. No. 5,643,050 of Chen, and U.S. Pat. No. 5,643,406 of Shimomura et al.

In U.S. Pat. No. 5,575,707 of Talieh et al., a wafer polishing system has a plurality of small polishing pads which together are used to polish a semiconductor wafer.

As shown in U.S. Pat. No. 5,624,304 of Pasch et al., the polishing pad may be formed in several layers, and a circumferential lip may be used to retain a desired depth of slurry on the polishing surface.

A CMP polishing pad has one or more layers and may comprise, for example, felt fiber fabric impregnated with blown polyurethane. Other materials may be used to form suitable polishing pads. In general, the polishing pad is configured as a compromise polishing pad—that is a pad having sufficient rigidity to provide the desired planarity, and sufficient resilience to obtain the desired continuous tactile pressure between the pad and the substrate as the substrate thickness decreases during the polishing process.

Polishing pads are subjected to stress forces in directions both parallel to and normal to the pad-substrate interfacial surface. In addition, pad deterioration may occur because of the harsh chemical environment. Thus, the adhesion strength of the polishing pad to the platen must be adequate to resist the applied multidirectional forces during polishing, and chemical deterioration should not be so great that the pad-to-platen adhesion fails before the pad itself is in need of replacement.

Pores or depressions in pads typically become filled with abrasive materials during the polishing process. The resulting "glaze" may cause gouging of the surface being polished. Attempts to devise apparatus and "pad conditioning" methods for removing such "glaze" materials are illustrated in U.S. Pat. No. 5,569,062 of Karlsrud and U.S. Pat. No. 5,554,065 of Clover.

In any case, polishing pads are expendable, having a limited life and requiring replacement on a regular basis, even in a system with pad conditioning apparatus. For example, the working life of a typical widely used CMP polishing pad is about 20–30 hours.

Replacement of polishing pads is a difficult procedure. The pad must be manually pulled from the platen, overcoming the tenacity of the adhesive which is used. The force required to manually remove a 30-inch diameter pad from a bare aluminum or ceramic platen may exceed 100 lbf (444.8 Newtons) and may be as high as 150 lbf (667.2 Newtons) or higher. Manually applying such high forces may result in personal injury as well as damage to the platen and attached machinery.

SUMMARY OF THE INVENTION

The invention comprises the application of a permanent, low adhesion, i.e. "non-stick," coating of uniform thickness to the platen surface. Exemplary of such coating materials are fluorinated compounds, in particular fluoropolymers including polytetrafluoroethylene (PTFE) sold under the trademark TEFLON by DuPont, as well as polymonochlorotrifluoroethylene (CTFE) and polyvinylidene fluoride ($PVF_2$). The coating retains its tenacity to the underlying platen material, and its relatively low adhesion to other materials, at the temperatures, mechanical forces, and chemical action encountered in CMP processes.

BRIEF DESCRIPTION OF THE SEVERAL VIEWS OF THE DRAWINGS

The invention is illustrated in the following figures, wherein the elements are not necessarily shown to scale.

DETAILED DESCRIPTION OF THE INVENTION

Figure 1:
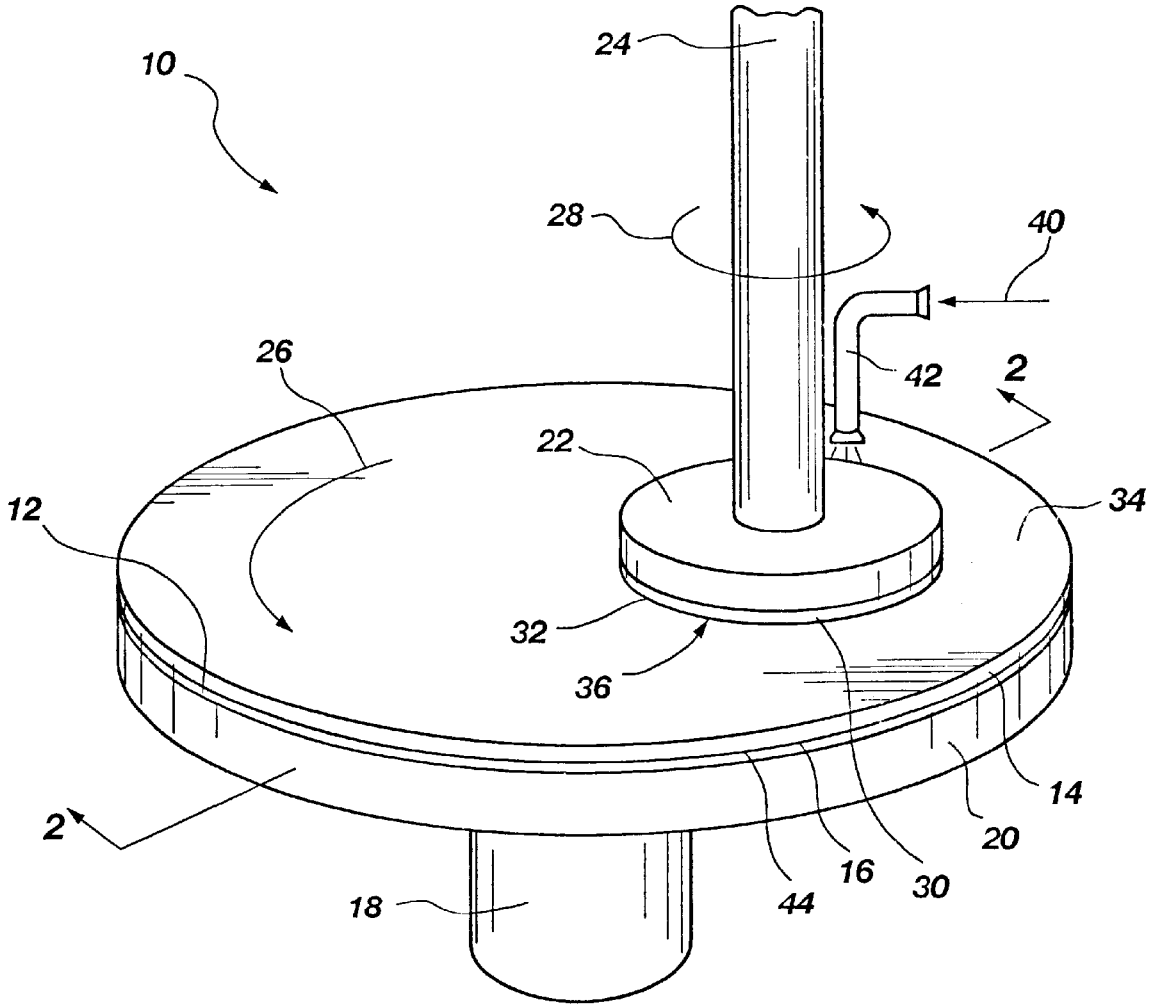
Fig. 1 (PRIOR ART)
FIG. 1 is a perspective partial view of a polishing apparatus of the prior art.
Figure 2:
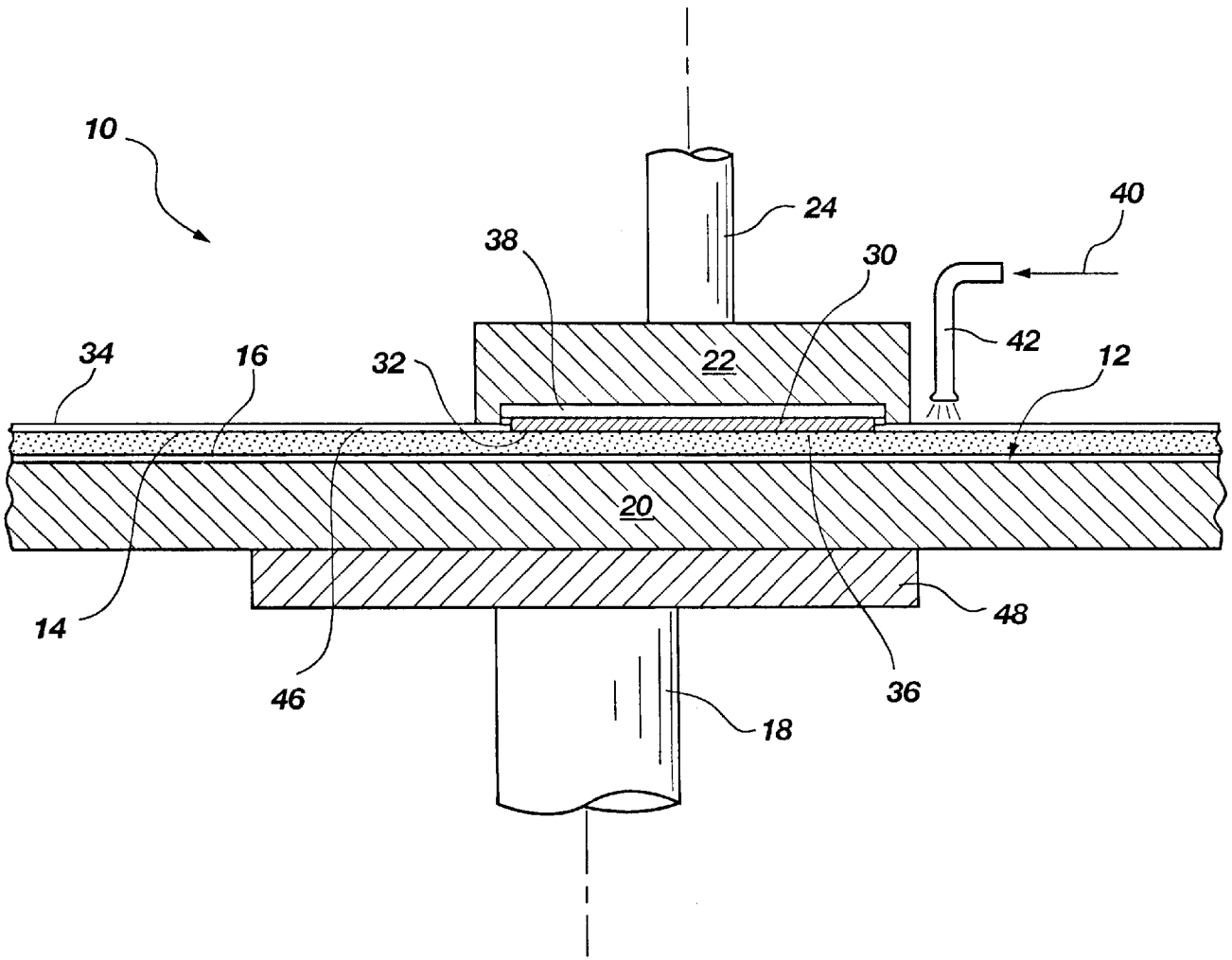
Fig. 2 (PRIOR ART)
FIG. 2 is a cross-sectional view of a portion of a polishing apparatus of the prior art, as taken along line 2—2 of FIG. 1.

Portions of a typical prior art chemical mechanical polishing (CMP) machine 10 are illustrated in drawing FIGS. 1 and 2. A platen 20 has attached to its upper surface 12 a polishing pad 14 by a layer of adhesive 16. If it is desired to rotate platen 20, its shaft 18, attached to the platen 20 by flange 48, may be turned by a drive mechanism, such as a motor and gear arrangement, not shown.

A substrate 30 such as a semiconductor wafer or optical lens is mounted on a substrate carrier 22 which may be configured to be moved in a rotational, orbital and/or vibratory motion by motive means, not shown, through shaft 24. In a simple system, shafts 18 and 24 may be rotated in directions 26 and 28 as shown. The substrate 30 is held in the carrier 22 by friction, vacuum or other means resulting in quick release following the polishing step. A layer 38 of resilient material may lie between the substrate 30 and carrier 22. The surface 32 of the substrate 30 which is to be planarized faces the polishing surface 34 of the pad 14 and is compressed thereagainst under generally light pressure during relative movement of the platen 20 (and pad 14).

In chemical mechanical polishing (CMP), a polishing slurry 40 is introduced to the substrate-pad interface 36 to assist in the polishing, cool the interfacial area, and help maintain a uniform rate of material removal from the substrate 30. The slurry may be introduced e.g. via tubes 42 from above, or may be upwardly introduced through apertures, not shown, in the polishing pad 14. Typically, the slurry 40 flows as a layer 46 on the pad polishing surface 34 and overflows to be discarded.

Upward removal of a polishing pad 14 from the platen surface 12 is generally a difficult operation requiring high removal forces. Pad replacement is necessary on a regular basis, and the invention described herein and illustrated in drawing FIGS. 3 through 6 makes pad replacement easier, safer and faster.

Figure 3:
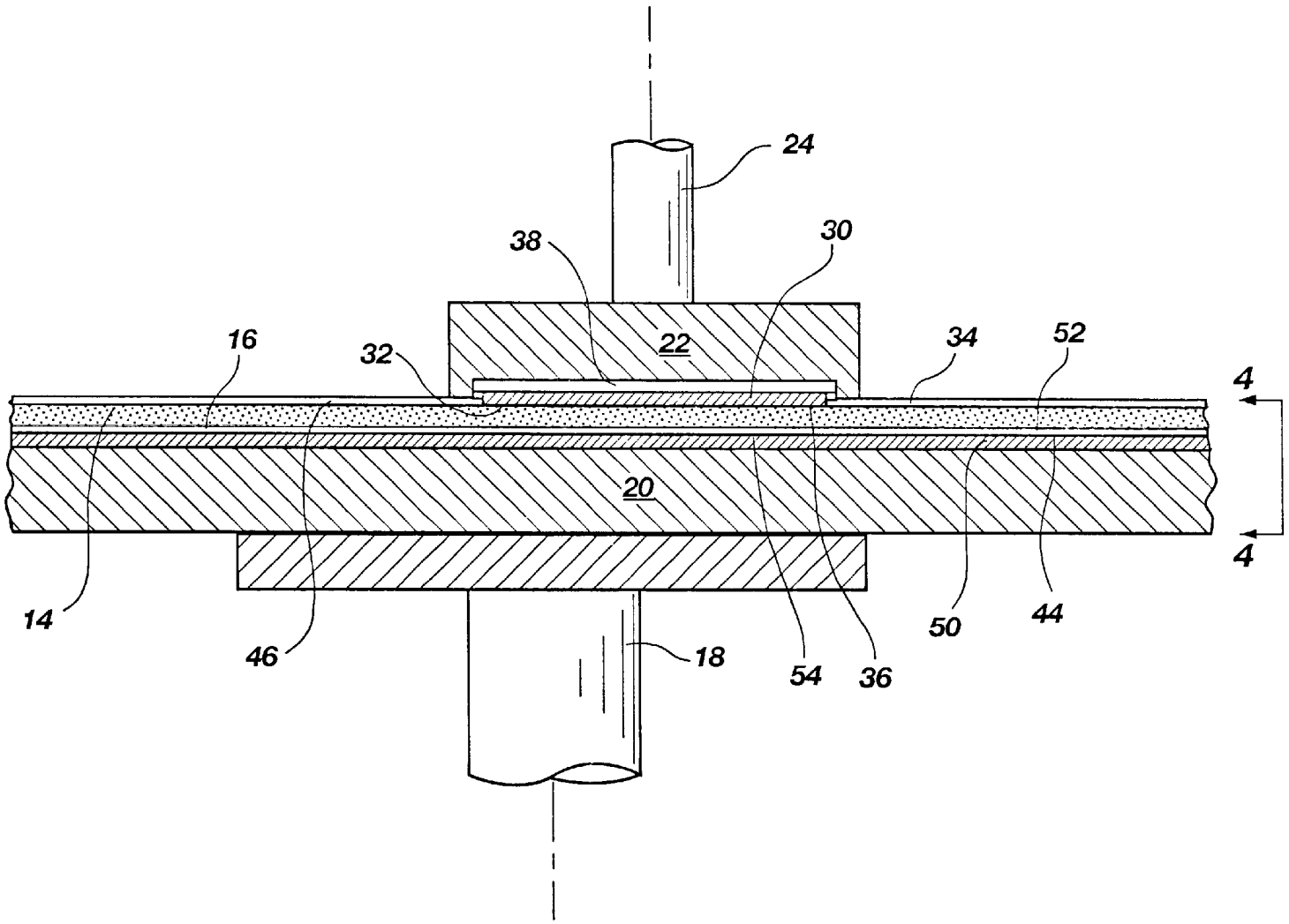
FIG. 3 is a cross-sectional view of a portion of a polishing apparatus of the invention.
Figure 4:
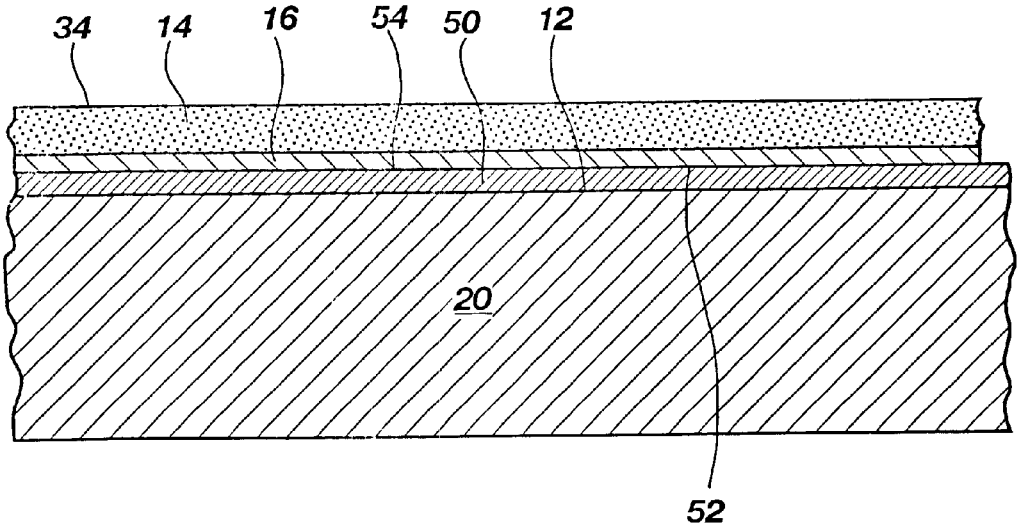
FIG. 4 is a cross-sectional view of a portion of a platen and polishing pad of the invention, as taken along line 4—4 of FIG. 3.

Turning now to drawing FIGS. 3 and 4, the prior art polishing apparatus of drawing FIG. 2 is shown with a platen 20 modified in accordance with the invention. Parts are numbered as in drawing FIG. 2, with the modification comprising a permanent coating 50 of a "non-stick" or low-adhesion material applied to the upper surface 12 of the platen 20, along coating/adhesive interface 54. The polishing pad 14 is then attached to the coating 50 using a pressure sensitive adhesive (PSA) 16. It is common practice for manufacturers of polishing pads to supply pads with a high-adhesion PSA already fixed to the attachment surface 44 of the pads. It has been found that the adhesion of polishing pads 14 to certain low-adhesion coatings 50 with conventional high adhesion adhesives results in a lower release force, yet the bond strength is sufficient to maintain the integrity of the polishing pads 14 during the polishing operations. Typically, variables affecting the release force include the type and surface smoothness of the coating 50, the type and specific adhesion characteristics of the adhesive material 16, and pad size.

Figure 6:
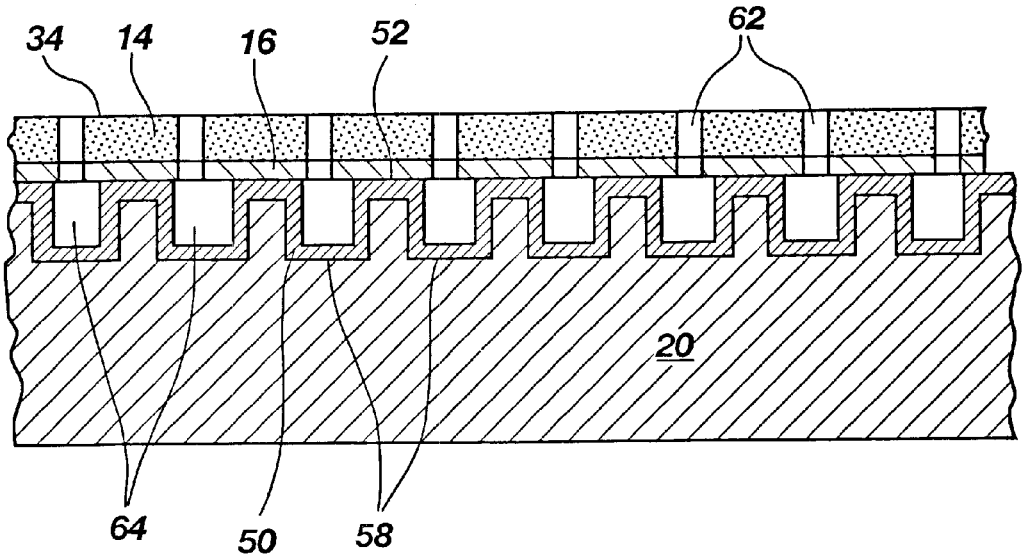
FIG. 6 is a cross-sectional view of a portion of a platen and polishing pad of the invention, as taken along line 6—6 of FIG. 5.
Figure 5:
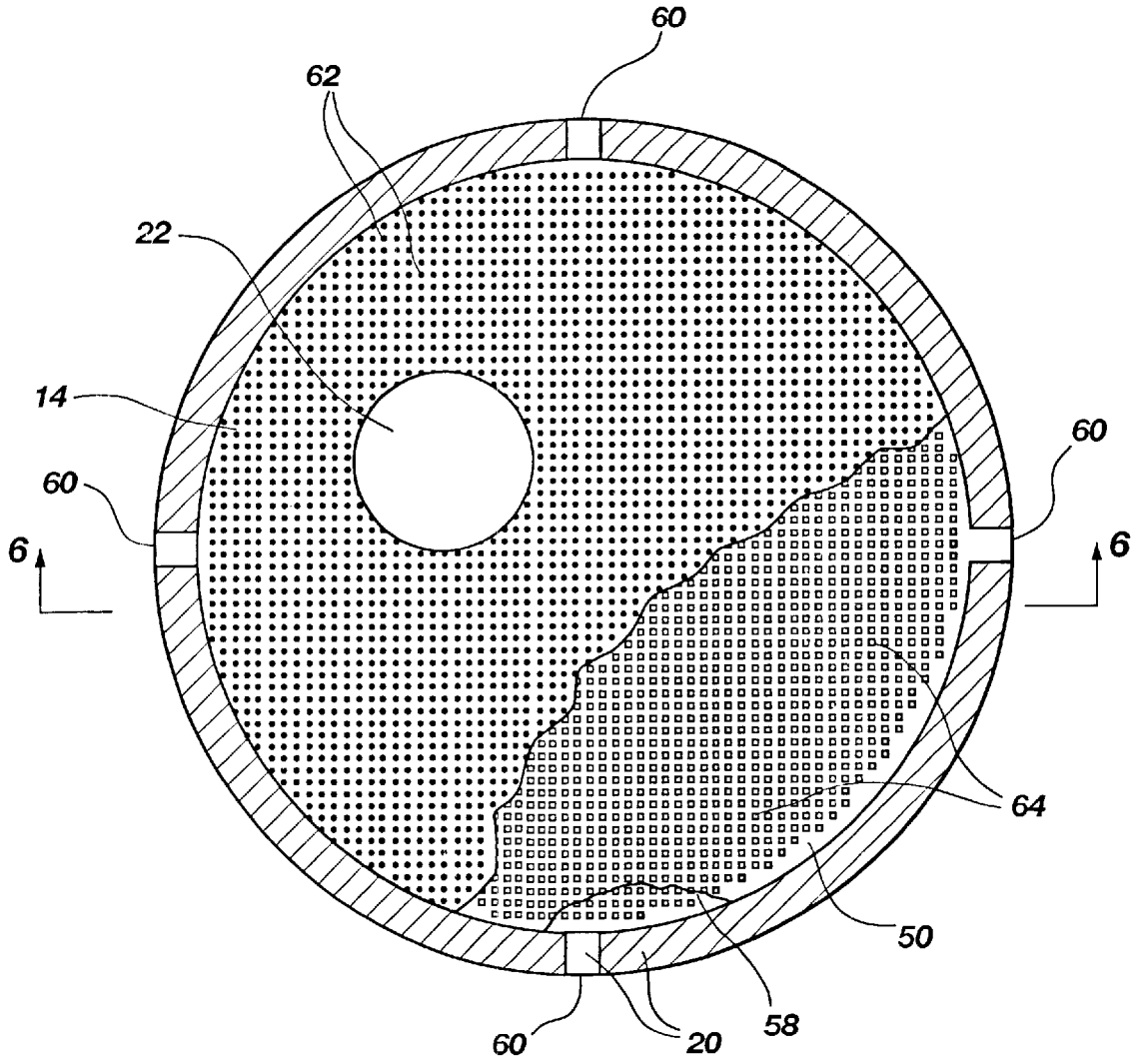
FIG. 5 is a top view of a polishing platen and pad of another embodiment of the invention.

Referring to drawing FIGS. 5 and 6, depicted is another version of the platen 20 which is coated with a low-adhesion coating 50 in accordance with the invention. In this embodiment, the platen 20 includes a network of channels 58, and slurry 40 is fed thereto through conduits 60. The low-adhesion coating 50 covers the platen 20 and, as shown, may extend into at least the upper portions of channels 58. Apertures 64 through the coating 50 match the channels 58 in the platen 20. The polishing pad 14 and attached pressure sensitive adhesive (PSA) 16 have through-apertures 62 through which the slurry 40 may flow upward from channels 58 and onto the polishing surface 34 of the pad 14.

The surface area of coating 50 to which the adhesive 16 may adhere is reduced by the apertures 64. This loss of contact area between adhesive 16 and platen coating 50 may be compensated by changing the surface smoothness of the coating or using an adhesive material with a higher release force.

Materials which have been found useful for coating the platen 20 include coatings based on fluoropolymers, including polytetrafluoroethylene (PTFE or "Teflon"), polymonochloro-trifluoroethylene (CTFE) and polyvinylidene fluoride ($PVF_2$). Other materials may be used to coat the upper surface 12 of platen 20, provided that the material has the desired adherence, i.e. release properties, with available adhesives, may be readily cleaned, and has a long life in the mechanical and chemical environment of polishing.

Various coating methods may be used. The platen 20 may be coated, for example, using any of the various viable commercial processes, including conventional and electrostatic spraying, hot melt spraying, and cementation.

In the application of one coating process to a modification of the platen 20, the upper surface 12 of the platen is first roughened to enhance adhesion. The coating material 50 is then applied to the upper surface 12 by a wet spraying or dry powder technique, as known in the art. In one variation of the coating process, white-hot metal particles, not shown, are first sprayed onto the uncoated base surface and permitted to cool, and the coating 50 is then applied. The metal particles reinforce the coating 50 of low-adhesion material which is applied to the platen 20.

The result of this invention is a substantial reduction in release force between polishing pad 14 and platen 20 to a level at which the pad may be removed from the platen with minimal effort, yet the planar attachment of the pad to the platen during polishing operations will not be compromised. The particular combination(s) of coating 50 and adhesive material 16 which provide the desired release force may be determined by testing various adhesive formulations with different coatings.

Another method for controlling the release force is the introduction of a controlled degree of "roughness" in the coating surfaces 52 (including surfaces of fluorocarbon materials) for changing the coefficient of friction. The adhesion of an adhesive material 16 to a coating 50 may be thus controlled, irrespective of the pad construction, size or composition.

The use of a coating 50 of the invention provides useful advantages in any process where a polishing pad 14 must be periodically removed from a platen 20. Thus, use of the coating 50 is commercially applicable to any polishing method, whether chemical mechanical polishing (CMP), chemical polishing (CP) or mechanical polishing (MP), where a polishing pad 14 of any kind is attached to a platen 20.

EXAMPLE

A piece of flat aluminum coated with polytetrafluoroethylene (PTFE) was procured. The particular formulation of PTFE was Malynco 35011 Black Teflon™, applied to the aluminum.

Conventional CMP polishing pad samples were obtained in a size of 3.7×4.2 inches (9.4×10.67 cm.). The area of each pad was 15.54 square inches (100.3 square cm.). These pads were identified as SUBA IV psa 2 adhesive pads and were obtained from Rodel Products Corporation of Scottsdale, Ariz.

The polishing pads included a polyurethane based pressure sensitive adhesive (PSA2) on one surface. The pads were placed on the coated aluminum, baked at 53° C. for two hours under slight compression, and cooled for a minimum of 45 minutes, thereby bonding the pads to the PTFE surface.

Samples of the same pad material were similarly adhered to an uncoated aluminum surface of a polishing platen for comparison as test controls.

Tests were conducted to determine the force required to remove each pad from the surface coating and the uncoated surfaces. The average measured removal forces were as follows:

Removal force from Malynco 35011 Black Teflon™ coated aluminum: 1.08 lbf.

Removal force from uncoated aluminum: 11.5 lbf.

Extrapolation to actual production size platens of 30 inch diameter indicates that pad removal forces may be reduced from about 100–150 lbf. (about 444.8–667.2 Newtons) to about 15 lbf. to about 25 lbf. (about 66 to 112 Newtons). This force is sufficient to maintain pad-to-platen integrity during long-term polishing but is a significant reduction in the force required for pad removal and replacement.

It is apparent to those skilled in the art that various changes and modifications, including variations in pad type and size, platen type and size, pad removal procedure, etc. may be made to the polishing apparatus and method of the invention as described herein without departing from the spirit and scope of the invention as defined in the following claims.

What is claimed is:

1. A polishing apparatus used for the chemical-mechanical-planarization of at least one wafer, said polishing apparatus having a polishing pad having an attachment surface for attaching said polishing pad to a portion of said polishing apparatus and having a polishing surface for planarizing a surface of said wafer using said chemical-mechanical-planarization process by the movement of said polishing pad with respect to said wafer, comprising:

a platen having a first surface for adhesive attachment of the attachment surface of the polishing pad thereto, said platen including a coating of a fluoropolymer material on at least a portion of the first surface thereof for the adhesive attachment of the polishing pad thereto;

a carrier for holding a wafer against said polishing surface of said polishing pad; and apparatus for moving said platen and substrate carrier relative to each other for said mechanical-chemical-planarization process of at least a portion of the surface of a wafer.

2. The polishing apparatus of claim 1, wherein said fluoropolymer material comprises one of polytetrafluoroethylene (TFE), polymonochlorotrifluoroethylene (CTFE) and polyvinylidene fluoride ($PVF_2$).

3. The polishing apparatus of claim 1, wherein said platen comprises one of a metal and a ceramic material.

4. The polishing apparatus of claim 1, wherein said platen comprises an aluminum material.

5. The polishing apparatus of claim 1, wherein said platen includes channels for slurry flow formed in said first surface of said platen.

6. The polishing apparatus of claim 1, further comprising:

an adhesive material joining said attachment surface of a polishing pad to said coating of fluoropolymer on at least a portion said platen.

7. A platen for the planarizing of at least a portion of a surface of a wafer located in a polishing machine used in a chemical-mechanical-polishing process of said wafer, said platen used with a polishing pad having an attachment surface and a polishing surface, said platen comprising a rigid member having a substantially planar first surface having at least a portion thereof coated with a fluoropolymer coating for attachment of the attachment surface of a polishing pad using an adhesive material applied to the attachment surface of a polishing pad for attaching at least a portion of said polishing pad to at least a portion of said fluoropolymer coating on said first surface of said platen.

8. The platen of claim 7, wherein said platen is configured to rotate about an axis normal to said first surface.

9. The platen of claims 7, wherein the adhesive material is a pressure sensitive adhesive material.

10. The platen of claim 7, wherein said fluoropolymer coating comprises one of polytetrafluoro- ethylene (TFE), polymonochlorotrifluoroethylene (CTFE) and polyvinylidene fluoride ($PVF_2$).

11. The platen of claim 7, wherein said platen has the first surface configured for use in a chemical mechanical polishing process using a polishing pad adhesively attached to the fluoropolymer coating.

12. The platen of claim 7, wherein said first surface of said platen has channels therein for passage of a slurry therethrough, said fluoropolymer coating on said first surface of said platen configured for adhesive attachment of a polishing pad having apertures extending therethrough for discharge of said slurry onto said polishing surface.

13. The platen of claim 9, wherein said fluoropolymer coating comprises a roughened fluoropolymer coating to enhance adhesion between the fluoropolymer coating and said pressure sensitive adhesive material.

* * * * *

UNITED STATES PATENT AND TRADEMARK OFFICE

CERTIFICATE OF CORRECTION

PATENT NO. : 6,398,905 B1
DATED : June 4, 2002
INVENTOR(S) : Trent T. Ward

It is certified that error appears in the above-identified patent and that said Letters Patent is hereby corrected as shown below:

Column 1,
Line 10, change “586.” to -- 586, issued March 14, 2000. --

Column 6,
Line 51, after “portion” and before “said” insert -- of --

Signed and Sealed this

Thirteenth Day of July, 2004

JON W. DUDAS
*Acting Director of the United States Patent and Trademark Office*